US010928076B2

(12) United States Patent
Deal et al.

(10) Patent No.: US 10,928,076 B2
(45) Date of Patent: Feb. 23, 2021

(54) FURNACE INLET WATER COLLECTOR

(71) Applicant: Trane International Inc., Davidson, NC (US)

(72) Inventors: Jerry Mac Deal, Adams, TN (US); Jesus Garcia Gomez, Tyler, TX (US); Kendall D. Davenport, Tyler, TX (US); James R. M. Neal, Tyler, TX (US); Seth O. Holloway, Pueblo West, CO (US); Shivakumar Kolloju, Chennai (IN); Ragunanthanan Mylsamy, Chennai (IN); Emily Catherine Burke, Middletown, PA (US); Michael Bielmann, Katy, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 189 days.

(21) Appl. No.: 16/049,206

(22) Filed: Jul. 30, 2018

(65) Prior Publication Data

US 2020/0033011 A1 Jan. 30, 2020

(51) Int. Cl.
*F24D 19/08* (2006.01)

(52) U.S. Cl.
CPC ..... *F24D 19/08* (2013.01)

(58) Field of Classification Search
CPC ..... F24D 19/08; F01B 31/18; F24H 8/006; F05B 2260/602; Y02B 30/106; F16L 25/14
USPC ..... 126/110 R
See application file for complete search history.

(56) References Cited

U.S. PATENT DOCUMENTS 4,887,849 A * 12/1989 Briet ..... F16L 37/098 285/91
6,125,839 A * 10/2000 Elgowainy ..... F23C 7/00 126/85 B
2002/0115036 A1* 8/2002 Lyons ..... F01B 31/18 432/210
2015/0369413 A1* 12/2015 Dill ..... F16L 9/18 285/123.15

(Continued)

OTHER PUBLICATIONS

Fasco Air Moving Group; "Exhaust Adapter Assy."; Drawing No. 85014081; Jun. 7, 2013; 1 page.

(Continued)

*Primary Examiner* — Steven B McAllister
*Assistant Examiner* — John E Bargero
(74) *Attorney, Agent, or Firm* — Womble Bond Dickinson (US) LLP

(57) ABSTRACT

Described herein are embodiments of a furnace inlet water collector for an HVAC system. The inlet water collector may include a base having an air intake aperture; an inner wall having a first top end and a first bottom end, the first bottom end provided proximate to the base; an outer wall having a second top end and a second bottom end, the second bottom end provided proximate to the base, the inner wall having a diameter smaller than a diameter of the outer wall; one or more pipe stops provided proximate to the base and between the inner wall and outer wall, a height of the one or more pipe stops extending less than a height of the outer wall; and a drain coupled to the outer wall and in fluid communication with a channel displaced between the inner wall and the outer wall.

17 Claims, 10 Drawing Sheets

(56) References Cited

U.S. PATENT DOCUMENTS

2016/0003475 A1* 1/2016 Pestoor ..... F16L 25/14
126/317

OTHER PUBLICATIONS

Regal Beloit America, Inc.; "Blower Outlet"; Drawing No. 85014084; Oct. 19, 2010; 1 page.
MI Heating Guy; "Carrier 59TN6 Combustion Intake Trap Install"; YouTube; Nov. 18, 2015; https://www.youtube.com/watch?v=kHkcx4IVz-Y; 1 page.
MI Heating Guy; "Carrier Infinity 59TN6A120 Furnace Needs a Combustion Intake Trap"; Nov. 2, 2015; https://www.youtube.com/watch?v=ZLIuJzM53VU; 1 page.

* cited by examiner

FURNACE INLET WATER COLLECTOR

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial structures to provide heating and/or cooling in order to create comfortable temperatures inside areas associated with such structures. To provide conditioned airflow into such conditioned areas, most HVAC systems employ an air conditioning unit having a fan to move the conditioned air through the HVAC system and into the climate conditioned areas. Condensation may form on or in components of the HVAC system while in use.

SUMMARY OF THE DISCLOSURE

In an embodiment described herein, an inlet water collector is provided. The inlet water collector may comprise a base having an air intake aperture; an inner wall having a first top end and a first bottom end, the first bottom end provided proximate to the base; an outer wall having a second top end and a second bottom end, the second bottom end provided proximate to the base, the inner wall having a diameter smaller than a diameter of the outer wall; one or more pipe stops provided proximate to the base and between the inner wall and outer wall, a height of the one or more pipe stops extending less than a height of the outer wall; and a drain coupled to the outer wall and in fluid communication with a channel displaced between the inner wall and the outer wall.

In an embodiment described herein, an heating, ventilation, and/or air conditioning (HVAC) system is provided. The HVAC system may comprise a furnace comprising a combustion air intake; a combustion air intake pipe mated to an inlet water collector; and the inlet water collector coupled to the combustion air intake, the inlet water collector comprising: a base having an air intake aperture; an inner wall having a first top end and a first bottom end, the first bottom end provided proximate to the base; an outer wall having a second top end and a second bottom end, the second bottom end provided proximate to the base, the inner wall having a diameter smaller than a diameter of the outer wall; one or more pipe stops provided proximate to the base and between the inner wall and outer wall, a height of the one or more pipe stops extending less than a height of the outer wall; and a drain coupled to the outer wall and in fluid communication with a channel displaced between the inner wall and the outer wall.

For the purpose of clarity, any one of the embodiments disclosed herein may be combined with any one or more other embodiments disclosed herein to create a new embodiment within the scope of the present disclosure.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

It should be understood at the outset that although illustrative implementations of one or more embodiments of the present disclosure are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Described herein is a furnace inlet water collector. The collector may be designed to prevent condensation from entering a furnace cabinet. The collector may be installed at the combustion air inlet of a furnace. During operation, combustion air is drawn into the furnace via the combustion air inlet. The combustion air may include moisture that results in condensation forming on the interior of the combustion air intake pipe. The condensation may drip into the cabinet of the furnace and may cause damage to components of the furnace, including but not limited to the gas valve, integrated furnace control (IFC), and/or the inducer motor. The furnace inlet water collector may include an outer wall with an inner diameter slightly larger than an outer diameter of the combustion air intake pipe. A bottom end of the outer wall may be coupled to a base. The furnace inlet water collector may include one or more stops that the combustion air intake pipe may rest on. An inner wall with an outer diameter smaller than an inner diameter of the combustion air intake pipe may be coupled with the base as well. The inner wall, outer wall, and base may form a channel to catch condensation that forms on the interior of the combustion air intake pipe. The outer wall may have a drain hole for draining the captured condensation.

Figure 1A:
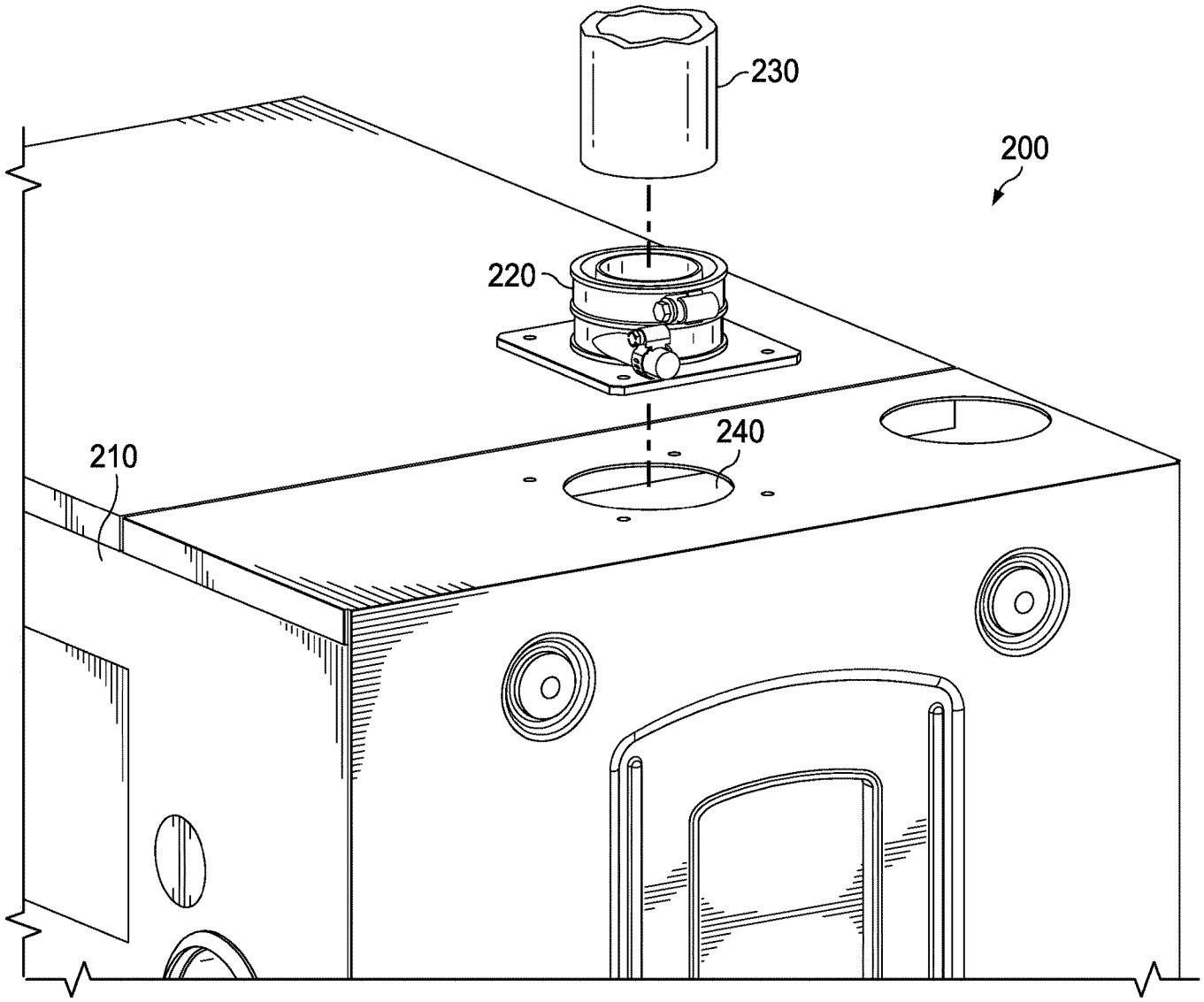
FIG. 1A is an exploded partial view of a gas furnace system with a furnace inlet water collector according to an embodiment of the disclosure.

FIG. 1A is an exploded partial view of a gas furnace system 200 with a furnace inlet water collector 220 according to an embodiment of the disclosure. The gas furnace system 200 may include a furnace 210, a furnace inlet water collector 220, a combustion air intake pipe 230, and a combustion air inlet 240. Furnace 210 may be a direct vent gas furnace, e.g., a combustion based system with an air intake for the combustion. Furnace 210 may be part of a larger HVAC system (not pictured). The furnace 210 may be used in a variety of applications including, but not limited to, a cooling only refrigeration system where a refrigeration system (not pictured) provides cooling and the furnace 210 provides heating; a heat pump refrigeration system, i.e., a dual fuel system, where the refrigeration system provides cooling and partial heating, and the gas furnace provides partial heating; and in a stand-alone setting where there is no cooling component of the system and the furnace provides heating.

Figure 1B:
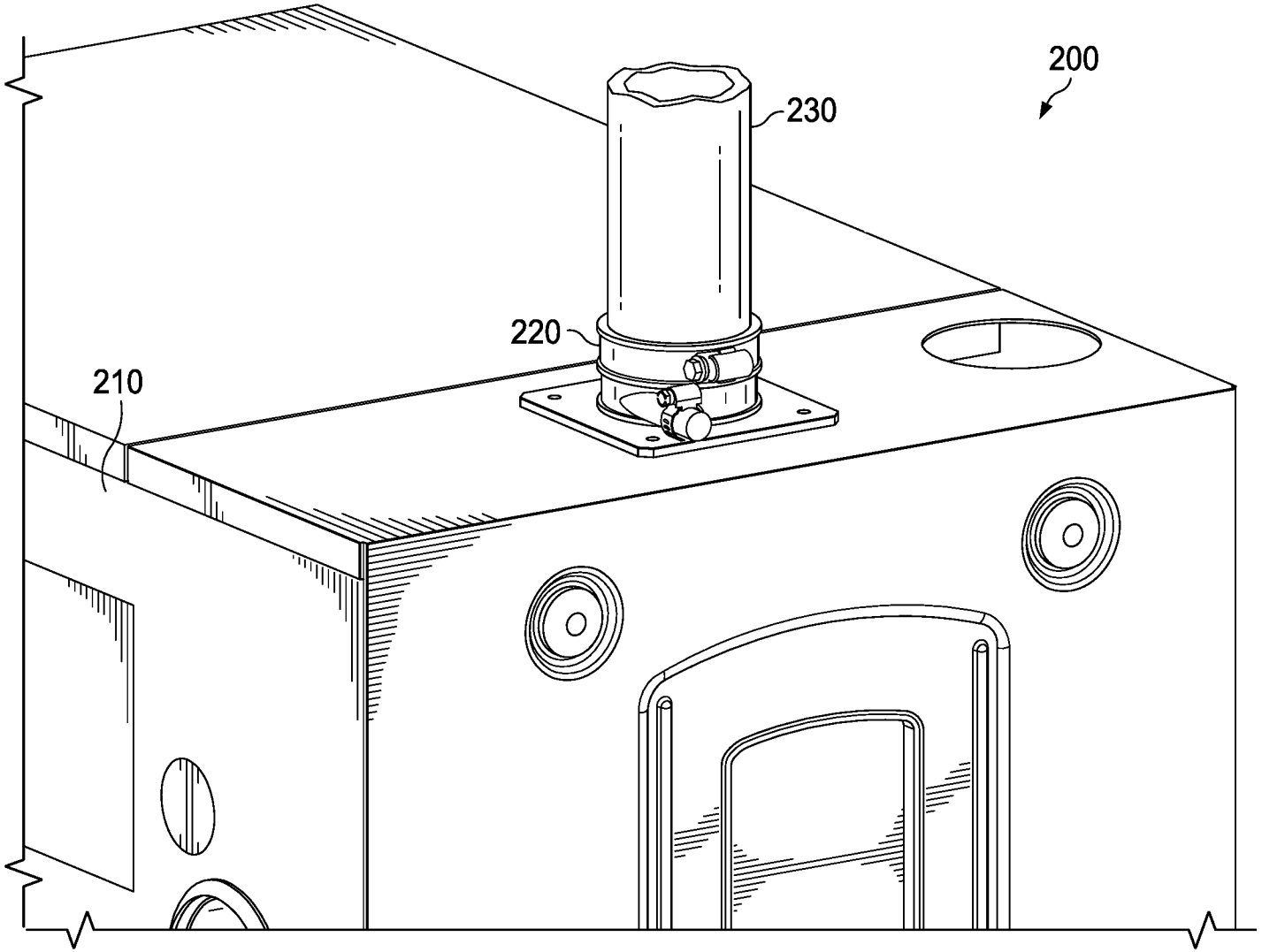
FIG. 1B is an assembled partial view of the gas furnace system shown in FIG. 1A.
Figure 2A:
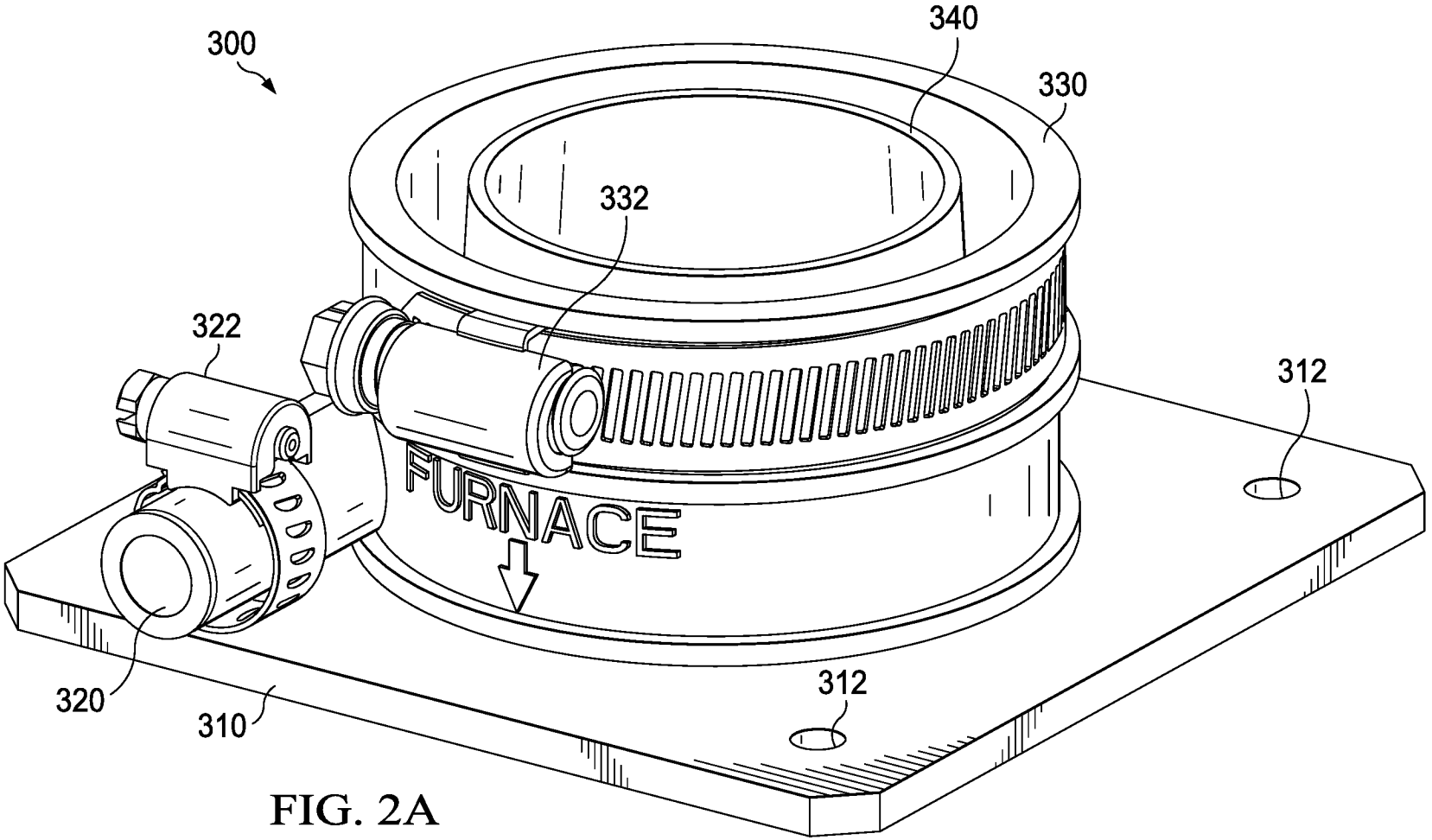
FIG. 2A is an isometric diagram of a furnace inlet water collector according to an embodiment of the disclosure.
Figure 2B:
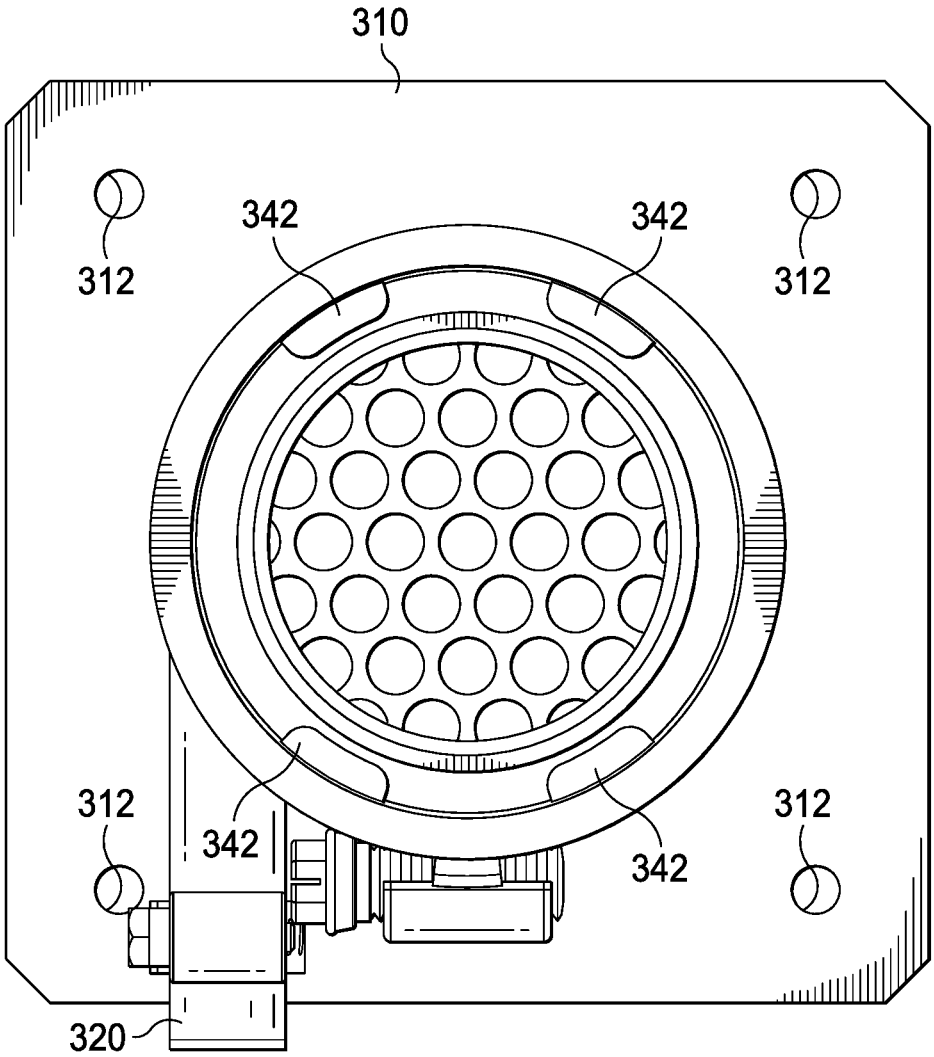
FIG. 2B is a top view of the furnace inlet water collector shown in FIG. 2A.
Figure 2C:
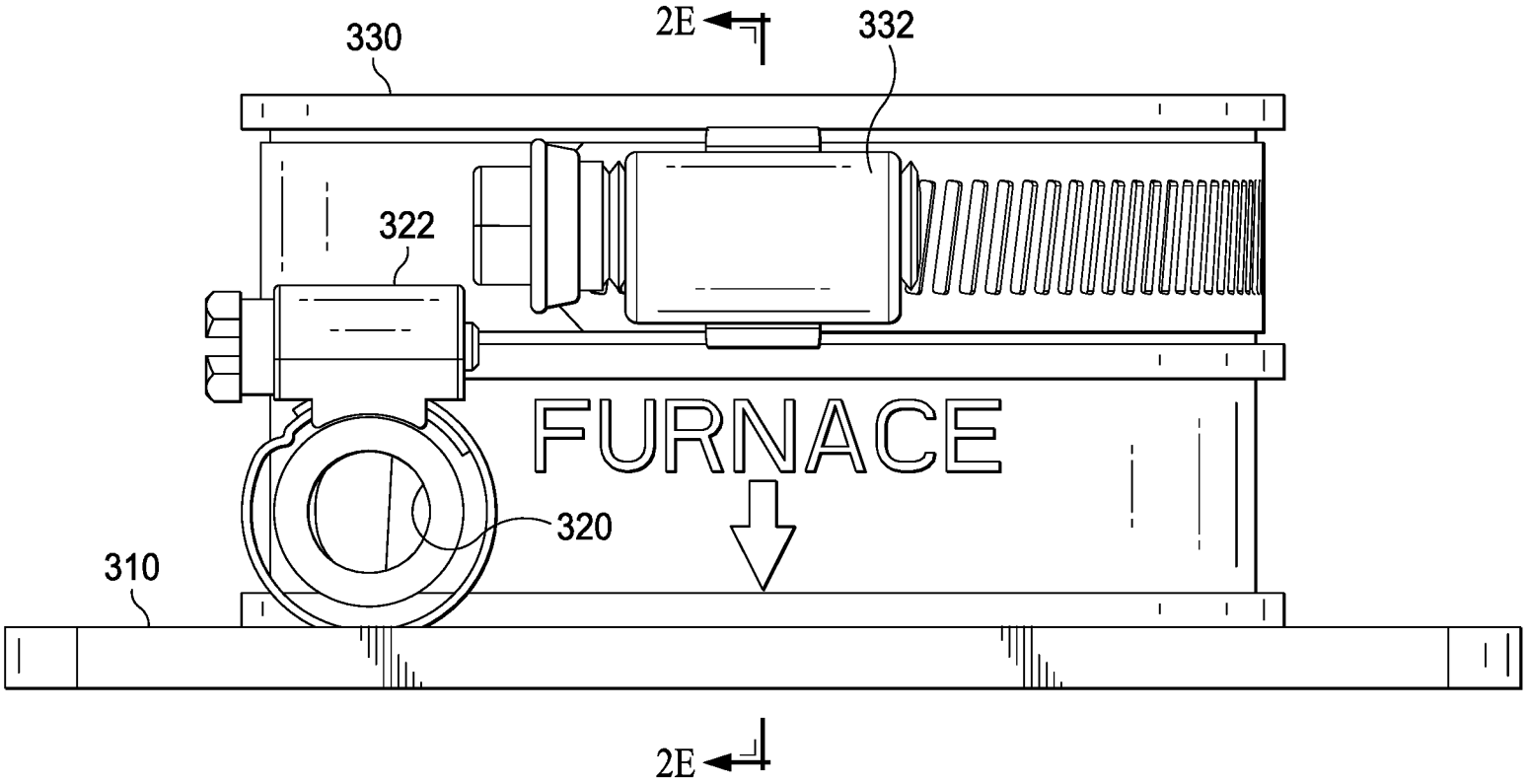
FIG. 2C is a front view of the furnace inlet water collector shown in FIG. 2A.
Figure 2D:
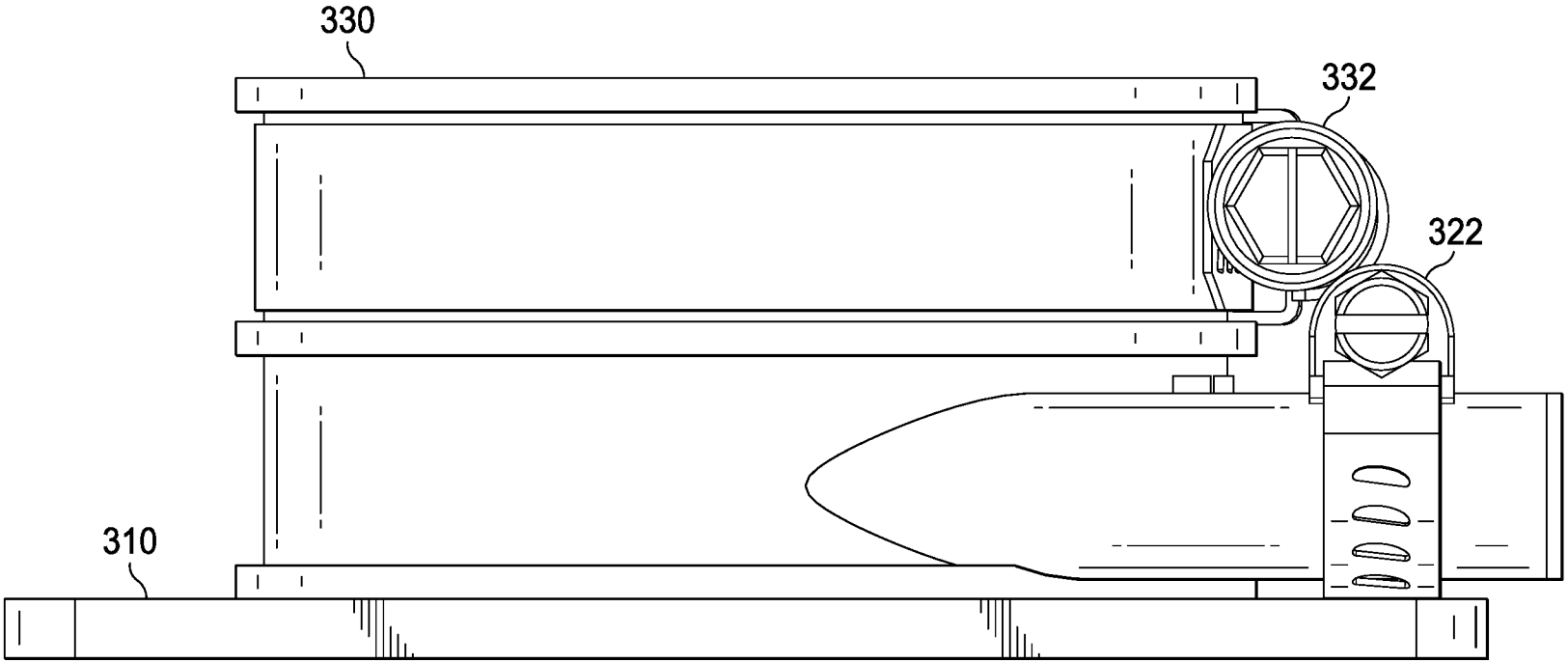
FIG. 2D is a side view of the furnace inlet water collector shown in FIG. 2A.
Figure 2E:
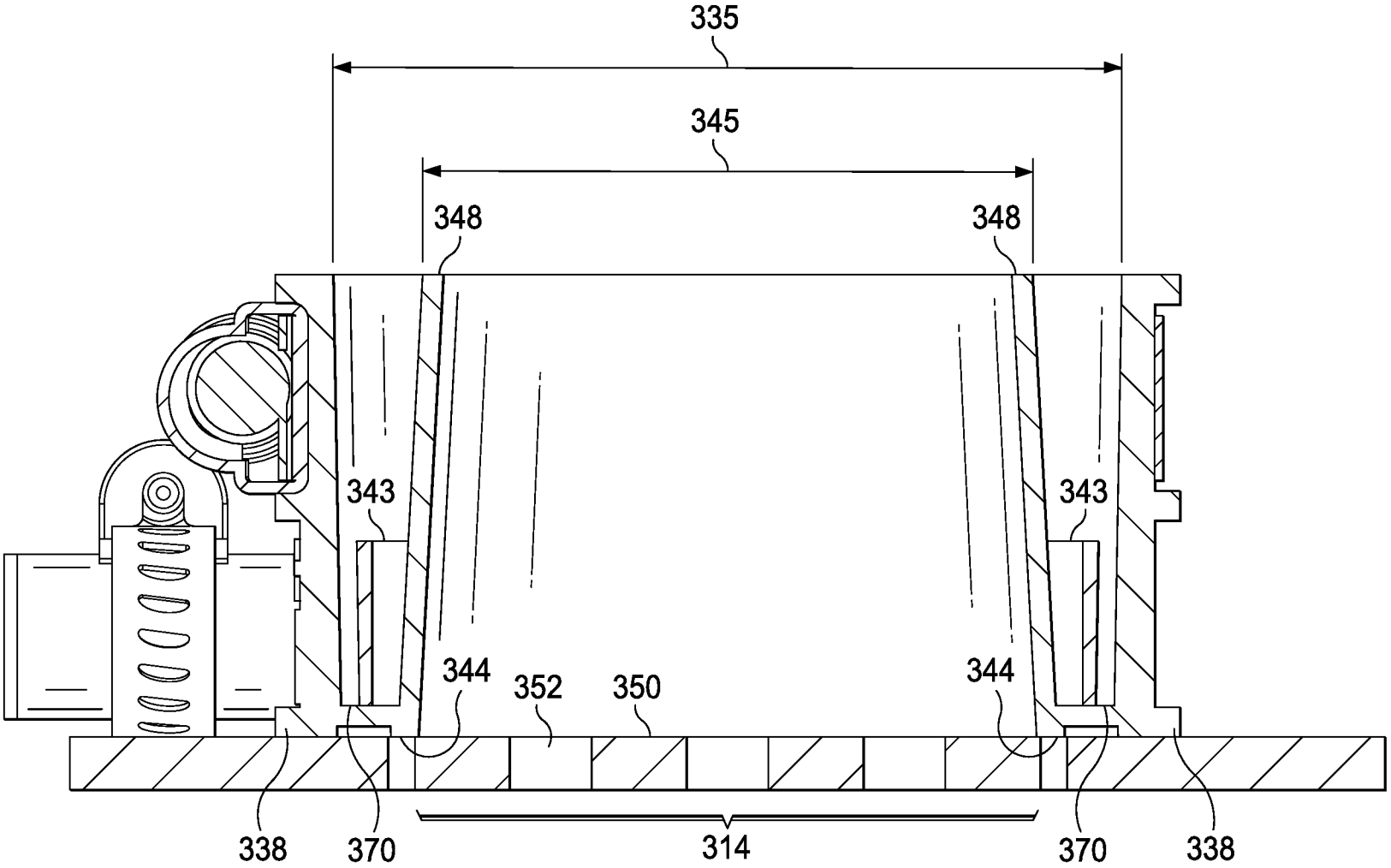
FIG. 2E is a sectional view of the furnace inlet water collector shown in FIG. 2A.
Figure 2F:
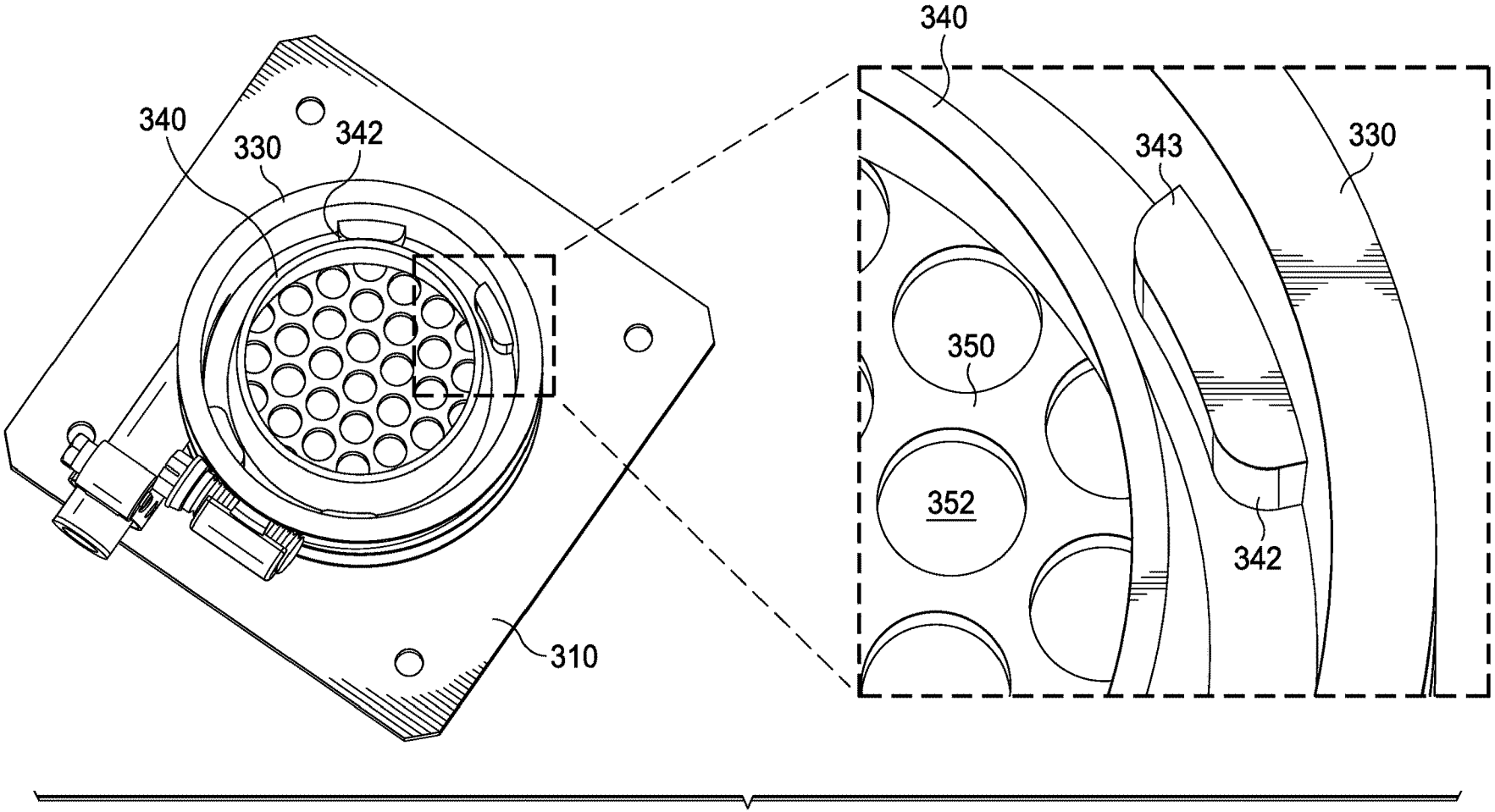
FIG. 2F is another isometric view with inset of the furnace inlet water collector shown in FIG. 2A.
Figure 2G:
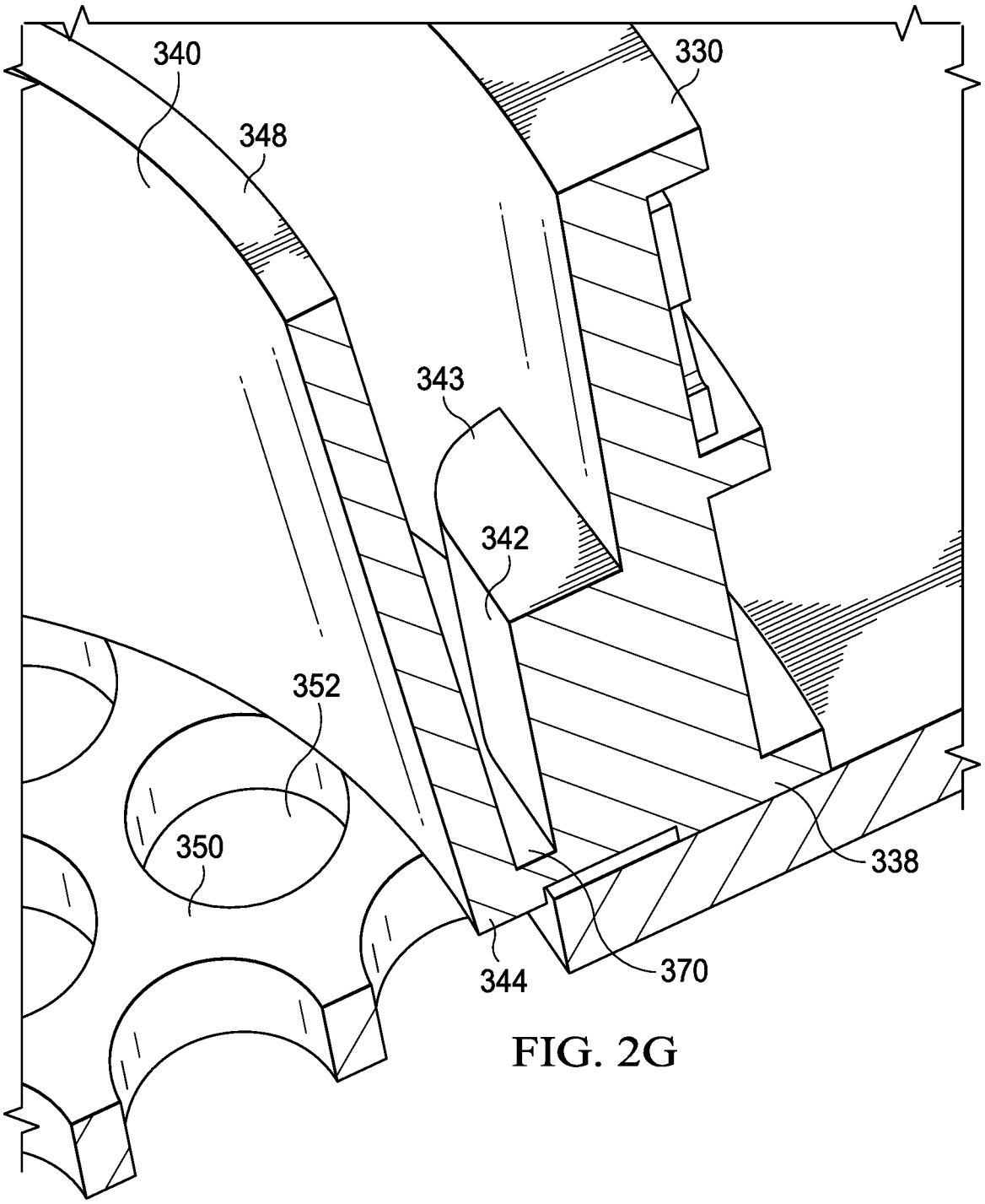
FIG. 2G is an isometric sectional view of the furnace inlet water collector shown in FIG. 2A.

FIG. 1B is an assembled partial view of the gas furnace system 200 of FIG. 1A. Collector 220 may be attached to a furnace 210. at the combustion air inlet 240. Collector 220 may be attached to the furnace 210 using, for example, screws, rivets, welds, etc. A combustion air intake pipe 230 may be inserted into the collector 220. Collector 220 is described in greater detail below. Condensation may form in the combustion air intake pipe 230 for a number of reasons including, but not limited to home depressurization, an unsealed furnace cabinet, improper combustion air system design (termination location), unapproved holes in the blower compartment of the furnace, or an unbalanced duct system. The aforementioned conditions may result in a negative pressure which results in outdoor air being pulled into the air intake pipe 230, even if the furnace is not in operation. If the air intake pipe 230 is at or below the dew point temperature of the outdoor air that is pulled in, then condensation will form in the combustion air intake pipe 230.

FIGS. 2A-2G are various views of an embodiment of a furnace inlet water collector 300. The collector 300 may be molded or formed from a single piece of material, e.g., rubber or plastic, or may be formed from multiple pieces that are joined together. The collector 300 includes a base 310. The base 310 may include one or more holes 312 for mounting the collector 300 to a furnace cabinet, e.g., furnace 210. Holes 312 may be sized for a particular fastener, e.g., a screw or rivet, to be used in attaching the collector 300 to the furnace cabinet. In other embodiments, holes 312 may be absent and the base 310 may be attached using other techniques, e.g., welding or adhesives. The base 310 also includes an aperture 314 for combustion air to enter the furnace.

The collector 300 includes an outer wall 330 and an inner wall 340. The outer wall 330 may be cylindrical in shape with an inner diameter 335 slightly larger than an outer diameter of a combustion air intake pipe, e.g., combustion air intake pipe 230. The bottom end 338 of outer wall 330 may be connected to the base 310. The inner wall 340 may be conical in shape with an outer diameter 345 less than an inner diameter of the combustion air intake pipe. The conical shape on inner wall 340 may include the top end 348 of the inner wall 340 having a smaller diameter 345 than the bottom end 344 of inner wall 340. The bottom end 344 of inner wall 340 may be connected to base 310. In some embodiments, the inner wall 340 may be cylindrical in shape, where the top end 348 and bottom end 344 of inner wall 340 are the same diameter, slightly less than the inner diameter of the combustion air intake pipe. The bottom end 344 of inner wall 340 may have a diameter substantially equal to aperture 314 to allow combustion air to enter the furnace. A channel 360 for collecting condensation may be formed between the outer wall 330, and inner wall 340. In some embodiments, base 310 may act as the bottom of the channel 360, in other embodiments a spacer 370 may be at the bottom of channel 360. In some embodiments, the bottom end 344 of inner wall 340 may abut the bottom end 338 of outer wall 330. In this case, inner wall 340 may be conical in shape, and the channel 360 may be formed by the inner wall 340 and the outer wall 330.

When a combustion air intake pipe, e.g., combustion air intake pipe 230, is installed into collector 300, clamp 332 may be tightened to hold the combustion air intake pipe in place. The clamp 332 may be a duct clamp or some other fastening device, e.g., duct tape, zip ties, etc. A drain 320 may be connected through outer wall 330 to allow condensation captured between inner wall 340 and outer wall 330 to drain from the collector 300. The drain 320 may be secured to a drain hose or drain pipe by tightening clamp 322. The clamp 322 may be a duct clamp or some other fastening device, e.g., duct tape, zip ties, etc.

Referring also to FIGS. 2B and 2E-2G, the collector 300 includes one or more pipe stops 342. Pipe stops 342 may be part of outer wall 330 or may be separate from, but abutting the outer wall 330. The bottom of pipe stops 342 may be connected to or rest on the base 310 or spacer 370. The height of pipe stops 342 may be selected to be equal to or taller than the height of drain 320 relative to the base 310 and shorter than inner wall 340. A combustion air intake pipe may rest on the top ends 343 of the pipe stops 342. While four pipe stops 342 are shown, other embodiments may use more or fewer pipe stops 342 of varying size or shape, e.g., a single cylindrical pipe stop 342. For example, pipe stops 342 may be mounted to outer wall 330 and may not touch base 310, or a single pipe stop 342 may be used.

The collector 300 may include a screen 350 across aperture 314. The screen 350 may include a number of openings 352. The screen 350 may prevent large debris from entering the combustion chamber of a furnace, e.g., furnace 210, where collector 300 is installed. While a screen 350 with round openings 352 is shown, any size or shape openings 352 may be used to prevent debris from entering the combustion chamber of the furnace.

Figure 3B:
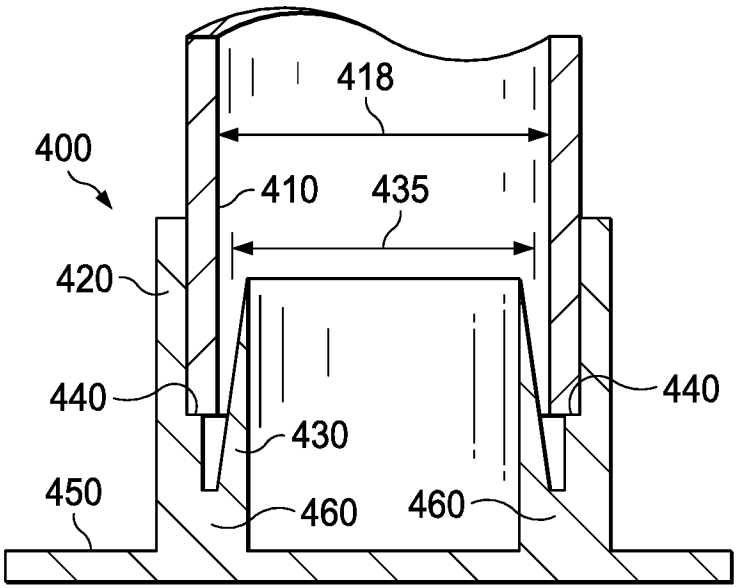
FIG. 3B is a sectional view of the furnace inlet water collector with seated combustion air intake pipe shown in FIG. 3A.
Figure 3A:
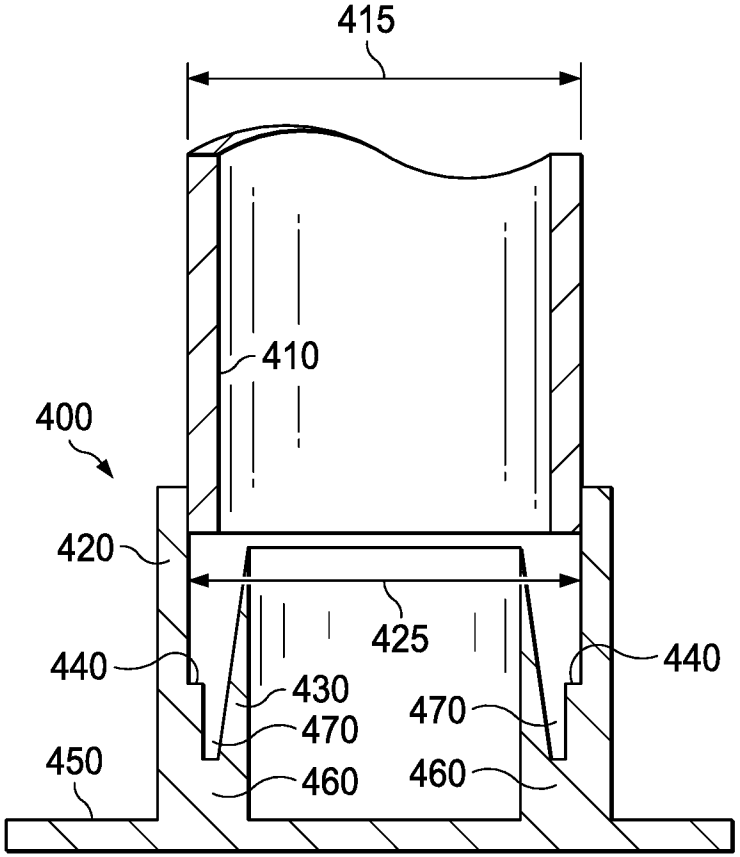
FIG. 3A is a sectional diagram of a furnace inlet water collector with partially inserted combustion air intake pipe according to an embodiment of the disclosure.

FIG. 3A is sectional diagram of a furnace inlet water collector 400 with a partially inserted combustion air intake pipe 410. FIG. 3B is sectional diagram of the furnace inlet water collector 400 of FIG. 3A with the combustion air intake pipe 410 shown in a seated position. The inlet water collector 400 includes outer wall 420, inner wall 430, pipe stops 440, base 450, and spacer 460. Outer wall 420 may be cylindrical in shape with a bottom end attached to the base 450. The inner diameter 425 of outer wall 420 may be slightly larger than the outer diameter 415 of combustion air intake pipe 410. Inner wall 430 may be cylindrical in shape with a bottom end attached to the base 450. The outer diameter 435 of inner wall 430 may be smaller than the inner diameter 418 of combustion air intake pipe 410. Pipe stops 440 may abut outer wall 420. As the combustion air intake pipe 410 is inserted as shown in FIG. 3A, the combustion air intake pipe 410 may seat on the pipe seats 440, as shown in FIG. 3B. As condensation forms on the inner wall of the combustion air intake pipe 410, the condensation may drip into a channel 470 formed between inner wall 440 and outer wall 420 and spacer 460. The condensation may then flow to a drain (not pictured) e.g., drain 320. Thus, condensation may be drained away from the combustion air intake, e.g., intake 240 of the furnace, e.g., furnace 210, preventing damage to the interior of the furnace.

Furthermore, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value.

Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A heating, ventilation, and/or air conditioning (HVAC) system, comprising:

a furnace comprising a cabinet including a combustion air inlet;

an inlet water collector mounted to the cabinet and coupled to the combustion air inlet; and a combustion air intake pipe engaged with the inlet water collector, such that the combustion air intake pipe is in fluid communication with the combustion air inlet through the inlet water collector; and wherein the inlet water collector comprises:

a longitudinal axis;

a base having an aperture;

an inner wall having a first top end and a first bottom end axially spaced from the first top end, wherein the first bottom end terminates proximate to the base;

an outer wall disposed about the inner wall, wherein the outer wall has a second top end and a second bottom end axially spaced from the second top end, wherein the second bottom end terminates proximate to the base, and wherein the inner wall has an outer diameter smaller than an inner diameter of the outer wall so that a channel is defined radially between the inner wall and the outer wall;

wherein the base extends radially outward from the longitudinal axis beyond the outer wall, and includes a plurality of holes configured to receive fasteners therethrough, and wherein the base is engaged with the cabinet;

one or more pipe stops provided proximate to the base, within the channel, wherein an axial length of the one or more pipe stops is less than an axial length of the outer wall; and a drain coupled to the outer wall and in fluid communication with the channel.

2. The HVAC system of claim 1, wherein the aperture is centered above the combustion air inlet.

3. The HVAC system of claim 1, wherein an axial distance of the one or more pipe stops from the base, is greater than or equal to an axial distance of the drain from the base.

4. The HVAC system of claim 1, wherein the combustion air intake pipe is set on the one or more pipe stops.

5. The HVAC system of claim 4, wherein the inner diameter of the outer wall is equal to an outer diameter of the combustion air intake pipe.

6. The HVAC system of claim 5, wherein the outer diameter of the inner wall is less than an inner diameter of the combustion air intake pipe.

7. The HVAC system of claim 1 further comprising a pipe clamp set on an outer face of the outer wall.

8. The HVAC system of claim 1 further comprising a drain clamp set on an outer face of the drain.

9. The HVAC system of claim 1 further comprising a screen set across the air intake aperture.

10. The HVAC system of claim 1, wherein the inner wall is conical in shape.

11. The HVAC system of claim 1, wherein at least one of the one or more pipe stops is mounted to the outer wall.

12. The HVAC system of claim 11, wherein all of the one of the one or more pipe stops is mounted to the outer wall.

13. The HVAC system of claim 11, wherein the at least one pipe stop mounted to the outer wall is mounted a distance from the base, such that the at least one pipe stop does not touch the base.

14. The HVAC system of claim 13, wherein the channel at the base extends under the at least one pipe stop mounted to the outer wall.

15. The HVAC system of claim 12, wherein all of the pipe stops mounted to the outer wall are mounted at a distance from the base, such that all of the pipe stops do not touch the base.

16. The HVAC system of claim 15, wherein the channel at the base extends under all of the pipe stops mounted to the outer wall.

17. The HVAC system of claim 6, wherein an inner surface of the intake pipe is mounted a distance away from the outer surface of the inner wall, such that a circumferential space exists between the intake pipe and inner wall.

* * * * *